US008312924B2

(12) United States Patent
Smith

(10) Patent No.: US 8,312,924 B2
(45) Date of Patent: Nov. 20, 2012

(54) METHOD AND APPARATUS TO TREAT A WELL WITH HIGH ENERGY DENSITY FLUID

(76) Inventor: David Randolph Smith, Kilgore, TX (US)

( * ) Notice: Subject to any disclaimer, the term of this patent is extended or adjusted under 35 U.S.C. 154(b) by 556 days.

(21) Appl. No.: 12/424,376

(22) Filed: Apr. 15, 2009

(65) Prior Publication Data

US 2009/0308613 A1 Dec. 17, 2009

Related U.S. Application Data

(60) Provisional application No. 61/045,062, filed on Apr. 15, 2008.

(51) Int. Cl.
*E21B 43/243* (2006.01)

(52) U.S. Cl. ..... 166/259; 166/303; 166/57; 166/305.1; 166/260

(58) Field of Classification Search ..... 166/305.1, 166/302, 303, 308.1, 57, 259–262
See application file for complete search history.

(56) References Cited

U.S. PATENT DOCUMENTS

| | | | | |
|---|---|---|---|---|
| 2,859,587 | A | 11/1958 | Scott et al. | |
| 3,246,697 | A * | 4/1966 | Natland | 376/275 |
| 3,367,123 | A | 2/1968 | Schambra | |
| 3,551,349 | A | 12/1970 | Kallfass | |
| 3,630,281 | A | 12/1971 | Fast et al. | |
| 3,777,816 | A * | 12/1973 | Meier | 166/260 |
| 3,842,910 | A * | 10/1974 | Zingg et al. | 166/308.1 |
| 3,858,655 | A | 1/1975 | Engle et al. | |
| 3,880,236 | A * | 4/1975 | Durning et al. | 166/302 |
| 4,593,763 | A * | 6/1986 | Burke | 166/302 |
| 4,641,710 | A | 2/1987 | Klinger | |
| 4,805,726 | A | 2/1989 | Taylor et al. | |
| 4,867,238 | A * | 9/1989 | Bayless et al. | 166/261 |
| 4,909,981 | A | 3/1990 | Garabedian | |
| 5,163,511 | A | 11/1992 | Amundson et al. | |
| 5,322,019 | A | 6/1994 | Hyland | |
| 5,433,271 | A | 7/1995 | Vinegar et al. | |
| 5,733,521 | A | 3/1998 | Minamikawa et al. | |
| 5,851,505 | A | 12/1998 | Nishide et al. | |
| 5,875,850 | A | 3/1999 | Burge et al. | |
| 5,928,621 | A | 7/1999 | Ledon et al. | |
| 6,001,324 | A | 12/1999 | Ledon et al. | |
| 6,054,109 | A | 4/2000 | Saito et al. | |
| 6,296,829 | B1 | 10/2001 | Devos et al. | |
| 6,447,744 | B1 | 9/2002 | Haas et al. | |
| 6,676,712 | B2 | 1/2004 | Creutz et al. | |
| 6,780,206 | B2 | 8/2004 | Nordhoff et al. | |
| 7,185,702 | B2 * | 3/2007 | Blauch et al. | 166/300 |

(Continued)

OTHER PUBLICATIONS

International Preliminary Report on Patentability issued Oct. 19, 2010 during prosecution of PCT/US2009/040683.

(Continued)

*Primary Examiner* — Nicole Coy
(74) *Attorney, Agent, or Firm* — Fulbright & Jaworski L.L.P.

(57) ABSTRACT

The invention relates to methods and apparatuses for the subterranean injection of reactive substances like propellants into wellbores and subterranean reservoirs. These methods and apparatuses controls the temperature of a reactive substance for safe handling at surface and controls the decomposition rate of the substances in the subterranean environment. In addition, these methods and apparatuses provide a means for safe dilution of reactive fluids in the event of a leak or spillage of the reactive substance.

65 Claims, 4 Drawing Sheets

U.S. PATENT DOCUMENTS

| | | | | |
|---|---|---|---|---|
| 7,874,350 | B2 * | 1/2011 | Pfefferle | 166/58 |
| 2003/0221579 | A1 | 12/2003 | Grattan | |
| 2006/0289166 | A1 | 12/2006 | Stromquist et al. | |
| 2007/0062704 | A1 * | 3/2007 | Smith | 166/303 |
| 2007/0199696 | A1 | 8/2007 | Walford | |

OTHER PUBLICATIONS

International Search Report issued Jun. 16, 2009 during prosecution of International Application PCT/US2009/040683.

Written Opinion issued Jun. 16, 2009 during prosecution of International Application PCT/US2009/040683.

Lemmer, et al., "Abwasservorkonzentrierung Nach Dem Niro Freeze Concentration Process", Chemie Ingenieur Technik, vol. 72, 2000, pp. 1229-1233. (German Language).

Schumb, et al., *Hydrogen Peroxide*, Reinhold Publishing Corporation, New York 1955, pp. 209-221 and pp. 302-309.

Wellinghoff, et al., "Schmelzkristallisation—Theoretische Voraussetzungen Und Technische Grenzen", Chem. Ing. Tech. vol. 63, 1991, pp. 881-891. (German Language).

Office Action from prosecution of Canadian Application 2,721,488 dated Jun. 28, 2012, 2 pages.

Office Action in Canadian proceedings of 2721488 mailed Jun. 28, 2012, 2 pages.

* cited by examiner

METHOD AND APPARATUS TO TREAT A WELL WITH HIGH ENERGY DENSITY FLUID

CROSS-REFERENCE TO RELATED APPLICATIONS

This application claims priority to U.S. Provisional Patent Application No. 61/045,062, filed on Apr. 15, 2008, which is incorporated by reference herein in its entirety.

TECHNICAL FIELD

The present invention is directed to methods and apparatus to inject high energy density substances into subterranean environments where they react. More specifically, this invention is directed to methods and apparatus to inject high energy density fluids like reactive mono-propellants and other hypergolic fluids into subterranean environments through wellbores into the earth.

BACKGROUND OF THE INVENTION

When a fluid, such as oil and natural gas, is being produced from a subterranean reservoir through a wellbore the reservoir's ability to produce such fluids is often enhanced by processes that inject fluids and solids from the surface through a wellbore into subterranean reservoirs. There is one field of work that uses these fluids and is known to those familiar with the art of oil and gas production as stimulation fluids or hydraulic fracturing fluid, and the process involving these fluids is often referred to as hydraulic fracturing job or stimulation job. It is commonly believed that fracturing the subterranean rock in the reservoir will enhance hydrocarbon production from the well. This is accomplished by pumping the fluids at very high pressures that are greater than the fracture pressure of the subterranean reservoir, thus cracking the rock.

In early days explosives like nitroglycerin were dropped in wells to break up, crack, or otherwise stimulate the subterranean rock to produce fluids. These explosives had the limitation of only cracking the rock near the wellbore. Therefore, the idea of extending the fractures and cracks in the rocks far afield from the wellbore was developed using the injection of high pressure hydraulic fracturing fluids. The fluids injected as stimulation or fracture fluids are often mixed at surface with a variety of chemicals and solids prior to injection. Many fluid types are used including freshwater, saltwater, nitrogen, carbon dioxide, hydrogen peroxide, monopropellants, hydrogen fluoride, acids, bases, surfactants, alcohols, diesel, propane, liquid natural gas, with many combinations of these fluids and many more fluids. Some of these fluids are blended with solids like sand, bauxite, ceramic proppants, propellants, proppants, and/or catalysts and the fluid and solids are pumped as a slurry into the wellbore and reservoir rocks.

There are further chemicals and fluids mixed at the surface and injected with stimulation processes like acid stimulation jobs or steam injection stimulations to improve the reservoir's ability to produce back the injected stimulation fluids to surface and enhance the reservoir production of hydrocarbon fluids. This is because the stimulation fluids remaining in the rock matrix of the subterranean reservoir or the chemicals transported by the fluids reduce the reservoirs ability to produce commercial hydrocarbon fluids. Additionally, those familiar with the art of stimulation or fracture technology in the oil and gas industry often mix at surface viscosifier agents and/or cross-linkers to the stimulation fluid, enhancing the fluid's ability to transport solids into the reservoirs. What is needed is a method and apparatus to add large amounts of heat generated inside the well during well stimulation as opposed to generating heat at surface and transporting the heat down the well.

Further, current industry practice of adding to stimulation fluids chemicals such as hydroxypropyl guars, polyacryl imides, and cellulose gelling agents reduces the hydraulic friction between the fluids being pumped and the well conduits that transport the fluids from surface to the subterranean reservoir. These are often referred to as friction reducer chemicals. As the oil and gas industry continues to find more gas and oil in lower permeability rocks, and in ever lower pressured "resource plays," like shale gas and coal bed methane, shale oil, and tar sands, it becomes ever more important to find substances to pump into the reservoir rock to enhance the hydrocarbon production by reducing the detrimental effects of the chemicals added for friction reduction.

Moreover, there is a problem with these methods when the fluids, particularly water, are produced back from the wells because they must be treated to re-use in subsequent wells or safely and environmentally disposed. There are many detrimental issues with this produced back fluid. For example, while flowing back from the subterranean environment, injected fluids containing friction reduction chemicals, gelling agents, scale inhibitors surfactants, crosslinkers, and hydrogen sulfide gas often contain bacteria that feed on the gels and poly acrylimdes and thus are not suitable for surface disposal or re-injection into subsequent wells during a subsequent stimulation, enhanced oil recovery method, or hydraulic fracture treatment. In the case of hydrogen sulfide gas production while flowing fluids from the wells, the ability to neutralize and treat this gas in the wellbore system would be a great improvement over the current art of flowing to facilities where the hydrogen sulfide ($H_2S$) gas is stripped out with various ammine solutions. Moreover, the lack of water resources in areas of large hydrocarbon recovery restricts the use of water as a treatment fluid.

Before the current invention, methods to enhance production of hydrocarbons from wells used by those familiar with the art of treating stimulation fluids mixed friction reducers, gelling agents, cross linkers, and/or surfactants into water at surface prior to injecting the fluid and chemicals down a well casing or tubing. These chemicals are typically batch mixed into the stimulation fluids to be injected at the surface into large holding tanks, known as frac tanks, or the chemicals are added "on the fly" at surface to the stimulation or fracture fluid by injecting them into the discharge of a large centrifugal pump at the surface. The mixed fluid is then pumped through high pressure pumps and injected into the well and the reservoir at very high pressures and normally high injection rates thereby exceeding the fracture pressure of the reservoir rock. Hence the stimulation or rock fracturing is largely done with hydraulic forces.

This process, often referred to as "hydraulic fracturing," is thought to crack or break the subterranean rock in the reservoir giving the reservoir more conductivity for the production of reservoir fluids like oil and gas. The objective is to put as much energy out away from the wellbore into the formation rock well beyond the wellbore to crack rock far field from the wellbore thereby improving the fluid conduction path from the far afield rock to the wellbore. Using current methods the hydraulic energy is highest at the wellbore where the stimulation or fracture chemicals enter into the well, and the energy available to crack and stimulate becomes progressively less as the stimulation and fracture fluids travel out beyond the wellbore. The typical method of treating heavy oil, tar sands, and depleted light oil reservoirs is to heat fresh water into steam and inject the steam into the wellbore once again concentrating most of the energy injected into the reservoir rock to near the wellbore. This stimulation or enhanced oil recovery method requires large amounts of fresh water, and the process loses considerable amounts of the heat energy in the transportation of the steam from surface to the subterranean environment.

A still further method of fracturing or stimulating subterranean rock reservoirs or stimulating subterranean reservoirs has been the dropping of explosives into the wells or injecting liquid and solid propellants, like nitroglycerin, dynamite and high grades of hydrogen peroxide, directly into reservoir rock. Hydrogen peroxide is known to decompose into hot water and oxygen in many reservoir rocks where the rocks act as a catalyst for the decomposition and no oxygen is required. The problem with this method is the very rapid and uncontrolled decomposition rate of hydrogen peroxide near the wellbore and the unpredictability of the reactivity of the reservoir rock as a catalyst.

It is desirable to use fluids with large chemical energy storage that do not require an oxygen environment to combust or decompose so that more chemical energy is available in the subterranean environment and may be placed far underground and far afield from the wellbore out into the reservoir to stimulate the subterranean reservoir with energy other than solely hydraulic energy, like heat and the expanding products of the fluids combustion and decomposition in the presence of catalyst, ignitors, and geothermal temperatures.

When a fluid, such as oil and natural gas, is being produced from a subterranean reservoir the reservoir energy depletes with time. It has been found that by the injection of certain fluids from the surface such as, nitrogen, water, steam, carbon dioxide, flue gas, air, and combinations of these fluids into a depleted or mature hydrocarbon reservoir the production of hydrocarbons from the depleted reservoir can be enhanced. There is one field of work that uses these fluids and is known to those familiar with the art of oil and gas production as Enhanced Oil Recovery, EOR. It is also known that the injection of heat can greatly enhance the injected fluid's ability to recover hydrocarbons from the depleted or mature reservoirs. This is particularly the case in "steam floods" and "steam assisted gravity drainage methods", known as SAGD to those in the field of EOR, which uses injected steam from the surface but suffer from the heat loss as the steam is injected from surface and heat is lost along the length of the well and the surface pipe infrastructure in a field thereby delivering less heat energy to the subterranean reservoir. What is needed is a method to generate heat in-situ.

It has been found that by the injection of certain fluids like air, natural gas, oxygen, and combinations of these fluids into a depleted or mature hydrocarbon reservoir the production of hydrocarbons from the depleted reservoir can be enhanced by igniting the oil, natural gas, coal, tar sand, shale oil, shale gas, or kerogen located in-situ in the reservoir. The field of work that uses these burning fluids is known to those familiar with the art of oil and gas production as Fire Flooding or In-Situ retorting. It is known that the placement of heat in-situ can greatly enhance the fuel in-situ to ignite. This is particularly the case in tar sands and shale oil reservoirs. What is needed is a method to generate heat in-situ in the reservoir as far from the wellbore as possible with ignitable fluids or with fluids that will assist in the ignition of the in-situ reservoir fluids.

Additionally, enhanced oil recovery projects, in-situ retorting of shale oil, fire floods, and fracture and stimulation treatments are often performed in parts of the world that have high ambient surface temperatures, where the use of explosive and reactive fluids like hydrogen peroxide becomes more dangerous as these fluids become more reactive as their temperature increases at surface. Likewise, enhanced oil recovery projects, in-situ retorting, fire floods, fracture, and stimulation treatments are often performed in parts of the world that have low surface temperatures, such that the reactive fluids like hydrogen peroxide might freeze, rendering them unpumpable. Currently, when using water as the work fluid this cold condition is easily resolved by heating the working fluid, e.g. water, with heat exchangers for stimulation or EOR projects. The methods to maintain the temperatures on the surface of highly reactive mono-propellants for example is not currently available. What is needed are methods and apparatus to allow for the temperature control of high energy density fluids to allow them to be injected safely at well sites into wells.

For example currently, a hot oiler truck comes to the well that is to be stimulated with water fracture based fluids and, by burning propane on the truck's heat exchangers and passing the working fluid to be pumped into the well, the truck heats up the working fluid on the truck such that heated fluid passes through heat exchangers on the truck and at the same time passes the working fluid, usually water, to be used for the stimulation treatment over the truck's heat exchanger and then re-circulates the fracture treatment water back to a heated holding tank. In this way the fracture treatment water is heated in cold weather such that it can be pumped and does not get solid on the surface. However, this heating method of pumping the fluids into a heat exchanger on a truck that is burning propane is exceedingly dangerous when the fluids to be pumped are mono-propellants like hydrogen peroxide or hydrazine.

A still further need to transmit large amount of energy beyond the wellbore in an interval is known to those familiar with the art of enhanced oil recovery, EOR, and in-situ retorting of hydrocarbons. This need to get energy out into the subterranean reservoirs beyond the wellbore can also be extended to the new and evolving field of enhanced gas recovery, EGR, and fluid sequestering like CO2. In both EOR and EGR, there is a need to get energy down wellbores and out into the reservoir. Indeed, the method of horizontal wells for steam flooding was developed to allow the steam energy to contact larger portions of the subterranean reservoir.

A still further method of enhanced oil recovery, or indeed subterranean in-situ retorting of oil is to place large heaters in the earth to heat hydrocarbons and kerogens such that they can be produced from the subterranean intervals. Subterranean heaters, however, cannot heat large areas of the subterranean reservoir far afield from the wellbore because the heater is located in wellbore and the earth is a great heat sink. To improve the heating of the subterranean reservoir, one must drill either a large number of heater wells and add exceeding large amounts of heat in these wells from surface or drill very expensive and long horizontal wells in which heaters are placed. In all cases the desire is to get energy, and in the case of enhanced oil and gas recovery, heat energy large distances from the wellbore. In the case of oil shale, the immense amount of heat needed to remove the oil from the shale is not cost effective, hence a method is needed to ignite and to feed oxygen to the oil shale, using the in-situ generated heat from the combustion of some of the oil shale or kerogen to heat the oil shale reservoir. However, getting oxygen to the oil shale is not easy due to the shale's low inherent permeability which makes the injection of oxygen into the rock away from the wellbore very difficult. What is needed is a fluid that can heat the rock, ignite in the rock, and deliver oxygen to the rock while assisting in the burning of in-situ fluids.

What is needed is a method to transmit large amounts of energy beyond the wellbore in a subterranean interval being stimulated to enhance oil or gas production. A further need is to accomplish this far field from the injection wellbore for enhancement effect in the subterranean reservoir with substances that will not reduce the permeability of the reservoir or otherwise inhibit the reservoir to produce fluids back to the wellbore and to the surface. A further need is to reduce the environmental damage done on the surface of the earth and sea by the flow back to surface of stimulation and fracture fluids containing chemicals and bacteria. A still further need is to have available methods and apparatuses to safely handle and control the rate of reaction of reactive fluids and solids such as propellants, catalyst, and fuels pumped into subterranean environments like reservoir rocks at outdoor well sites that may have cold and hot surface environments. Many wells are located in locations on the earth where the surface temperatures are below the sublimation temperatures of many reactive mono-propellant fluids like hydrogen peroxide or hydrazine. What is needed is a method to keep these reactive high energy density substances, like liquid propellants, from freezing at well sites with cold surface temperatures.

BRIEF SUMMARY OF THE INVENTION

The present invention is directed to new methods and apparatuses to treat subterranean reservoirs through wellbores with reactive high energy density substances. This invention teaches methods and apparatuses that allow substances such as mono-propellants, oxidizers, catalysts, and fuels to be injected into subterranean environments to release large amounts of energy into the subterranean environment by controlling their temperature, thus allowing these fluids to be injected safely.

In one aspect of the present invention, surface vessels, conduits, and/or pumps are designed to perform a process that maintains the highly reactive substances and their transport fluids in a low reactive state by controlling their temperature while at surface.

In a further aspect of the present invention highly reactive high energy density substances are frozen into solid form and mixed into cold fluids to allow the solid substances to be delivered to a well site, pumped and transported as a slurry into the well and out into the reservoir with the transport fluids that keep the substances cold. The invention further teaches methods to blend the substances with fuels, oxidizers, mono-propellants, and catalysts at low temperatures to keep the blend in a low reaction state.

In another aspect of the present invention highly reactive high energy density fluids are heated, and monitored to maintain them in a liquid state on surface at a well site where cold surface environment temperatures are below the propellants freezing point, to allow the propellant to be pumped as a liquid into the well.

In a still further aspect of the present invention a method is presented to form solid reactive materials from liquid reactive materials using cold solids to seed the formation of the reactive fluids.

In a still further aspect of the present invention a method is presented to ignite highly reactive high energy density fluids in a down hole reaction chamber connected to a coiled tubing thereby directing said fluids to be pumped from an appropriately temperature controlled surface storage vessel, through surface lines, through a coiled tubing string disposed in a well through a wellhead sealing pack off elastomeric device with a reaction chamber on the coiled tubing distal end that atomizes high energy density fluid and ignites the fluid allowing the coiled tubing to articulate in the well bore the position of the reaction chamber while pumping the fluid from surface thereby releasing heat and or decomposition products from the reaction chamber into the subterranean environment.

In a still further aspect of the present invention a method is presented to provide energy to a subterranean environment by directing a reactive high energy density fluid from a surface storage vessel (that is optionally temperature controlled), through surface lines, through a conduit such as a coiled tubing string disposed in a wellbore, and into the wellbore where the fluid decomposes or reacts. In some embodiments, upon exiting the conduit, the fluid enters a down hole reaction chamber connected to the conduit. In the reaction chamber, the high energy density fluid is ignited, and may atomized to assist in ignition. The reaction chamber can have a one-way valve that allows the fluid and/or reaction/decomposition products to exit the chamber and enter the formation, but prevents flow in the reverse direction.

The method can include reciprocating the reaction chamber (such as by reciprocating the conduit) to release heat or reaction/decomposition products along a length of the wellbore. At or near the wellhead, the conduit can be directed through an appropriate pack off elastomeric device to provide a seal.

In another aspect, a method is provided for the in situ treatment of hydrogen sulfide, comprising pumping a reactant that reacts with hydrogen sulfide to produce desirable products such as elemental sulfur into a wellbore via a stainless steel (as opposed to carbon steel) conduit and reacting the reactant with the hydrogen sulfide to produce desirable products. In some embodiments, the reactant comprises hydrogen peroxide and the product comprises elemental sulfur.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art of hydrocarbon production enhancement from wells that the conception and specific embodiment disclosed may be readily utilized as a basis for modifying or designing other structures and methods for carrying out well hydrocarbon production enhancement. For example the well production enhancement for enhanced oil recovery, in-situ processing of shale oil, coal, coal bed methane, shale gas, and tar sands, as well as other well enhancement fields, can use the methods and apparatuses of this invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawing, in which.

DETAILED DESCRIPTION OF THE INVENTION

As used herein, "a" or "an" means one or more. Unless otherwise indicated, the singular contains the plural and the plural contains the singular.

In many aspects and embodiments, the present invention uses reactive high energy density substances that can deliver a relatively high amount of energy per unit weight. Examples of such substances include 10% hydrogen peroxide, 100% hydrogen peroxide, hydrazine mixtures, and other substances.

Figure 1:
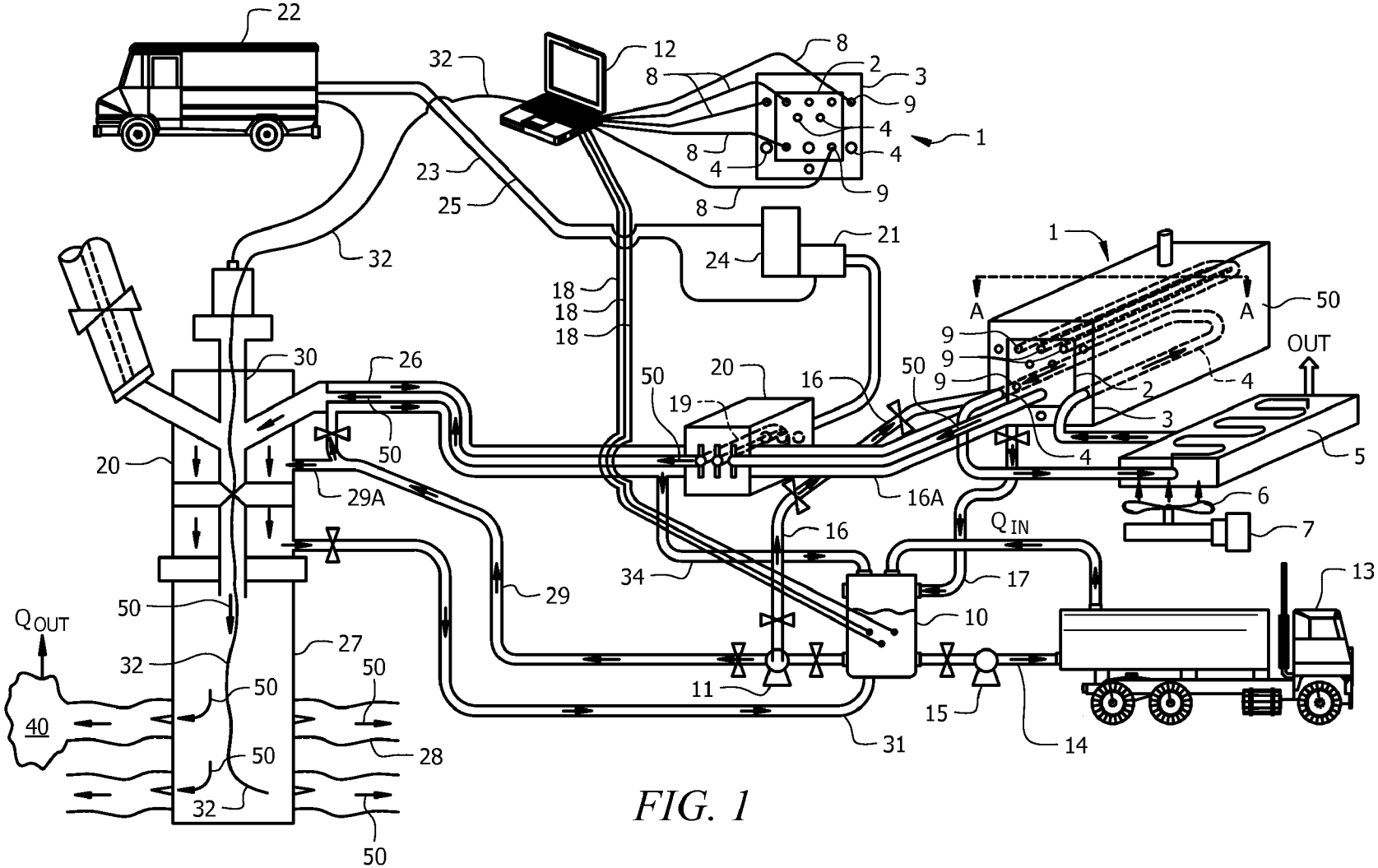
FIG. 1 is a schematic showing the well site and equipment of the present invention.

In the embodiment of FIG. 1, tank 1 holds a reactive fluid 50 and has shroud 3 located around inner tank 2. Many reactive fluids may be used, including but not limited to hydrogen peroxide, hydrazine, monopropellants, hydrogen fluoride, hypergolic fluids (i.e., combustible without an ignition source), acids, bases, alcohols, diesel, propane, liquid natural gas, and combinations thereof. The reactive fluid 50 is preferably stored, monitored, and temperature controlled inside inner tank 2. Located inside tank shroud 3 are heat exchanger tubes 4 connected to a heat exchanger 5, which is preferably outside reactive fluid tank 1. Heat exchange tubes 4 are also located inside inner tank 2. The heat exchange permits safe temperature control of a reactive fluid, preferably cooling it to a temperature to retard its reactivity, but keeping it above a temperature such that it can be pumped into the well. This allows a reactive fluid to be introduced to a well in a activity-reduced state so that it can be directed to the outer parts of the reservoir 28 before reacting completely. In some embodiments, temperature control is required to heat the reactive fluid, such as when the ambient temperature would freeze the fluid to a point where it cannot be pumped.

In one embodiment, heat exchanger fan 6 blows air across heat exchanger tubes 4 in heat exchanger 5, and is driven by prime mover 7. Other means of heat exchange are also in the scope of this invention. In one embodiment, the tank shroud 3 is filled with a suitable fluid, and heat exchanger tubes 4 are submersed in the reactive fluid. The reactive fluid is enclosed by shrouds filled with dilution fluids like water that allows for dilution of the reactive fluid in the event of a leak. In one embodiment, the fluid filling tank shroud 3 is water, and for convenience this disclosure may refer to water. Of course, other fluids can be used that provide either heat exchange or safety via dilution, or preferably, both. Heat exchanger 5, tank 1, inner tank 2, shroud 3, and tubes 4 are not limited to the geometries, orientations, or structure disclosed in the FIG. 1 and FIG. 2, but rather can be any form suitable for the objects of this invention.

The water in shroud 3 can be circulated from water tank 10 through pump 11 with the water returning from tank shroud 3 to water tank 10. In one embodiment, tank 1 can be instrumented with temperature monitoring sensors 8, and in one embodiment the sensors are optical fibers 8, disposed inside tubes 4 and tubes 9 located inside tank 1, both in tank shroud 3 and inside inner tank 2. Optical fibers 8 can be used as temperature sensors themselves and are preferably monitored with an Optical Time Domain Reflectometer machine ("OTDR") 12 that launches light down the fibers and interprets the backscatter light back to the machine to give continual distributed temperature profiles from the optical fibers 8. This device is often referred to as an OTDR Distributive Temperature System ("OTDR DTS"). Additionally, the circulation of water from tank 10 through tank 1 in shroud 3 allows for an even heat to be maintained in the reactive fluid inside inner tank 2. Thus, FIG. 1 shows the adding or removing of heat from the reactive fluid using a heat transfer fluid in tank 1. Additionally, FIG. 1 shows the continuously monitoring of the temperature of shroud 3 and fluid inside inner tank 2. For example, monitoring the temperature using optical fibers 8 interrogated with OTDR DTS machine 12.

The embodiment of FIG. 1 has a hot oiler truck 13 that can heat the water in tank 10, but other heating systems can be used. The hot oiler truck puts energy, $Q_{in}$, into the system. The water can be transferred from the tank 10 through suction line 14 by pump 15. The water is heated in hot oil truck 13 by burning propane on the truck and passing the water from tank 10 across the hot heat exchangers of truck 13 and then returning the heated water to tank 10. The heated water from tank 10 can then be transferred to tank 1 through pump 11 and line 16. The water from tank 1 is returned to tank 10 through line 17 to water tank 10. Temperature sensors such as optical fibers 18 can monitor the temperature in tank 10 via methods such as an OTDR DTS machine 12. Thus, the reactive fluid is indirectly heated by hot oil truck 13 using the fluid from tank, 10 which increases the safety of the temperature control process.

Thus FIG. 1 demonstrates how heat can be added to or removed from the reactive fluid 50 in tank 1 by using heat exchanger tubes 4 from the water in tank 10. In some cases, the water in tank 10 is heated from the heat exchanger on truck 13. The temperature of shroud 3 and the fluid inside inner tank 2 can be monitored continuously using temperature sensors, such as optical fibers interrogated with an OTDR DTS machine 12.

The embodiment in FIG. 1 shows a reactive fluid being transferred from tank 1 where the reactive fluid 50 is stored and maintained at a temperature sufficiently above its solid temperature to allow transport downhole but sufficiently below a temperature such that its action is reduced. In one embodiment, the chilled reactive fluid travels through injection pump 19 through a shrouded suction conduit 16A, which has water or other fluid circulated inside its shroud from water tank 10. Water is delivered to shroud of conduit 16A, via pump 11 and water line 16, and the water returns from the shroud through line 17.

In one embodiment, pump 19 is enclosed in shroud 20, which may use fluid from tank 10 in a manner similar to other shrouds described above. Pump 19 is powered by any known means, but preferably by hydraulic power pack 21 and controlled remotely from a frac van 22 with hydraulic controls via hydraulic control line 23. Hydraulic control pack 21 is powered by prime mover 24 that is preferably monitored and controlled remotely from the frac van 22 by hydraulic control line 25. The use of hydraulic power increases safety when working with reactive fluids.

Injection pump 19 pressurizes the reactive fluid and the substances from tank 1 and injects them into (preferably shrouded) high pressure conduit 26 for injection into well 27 and out into subterranean reservoirs 28. In a manner similar to other shrouds described, shrouded high pressure conduit 26 can have water supplied from tank 10 via pump 11 and line 29, and water is returned to water tank 10 through line 34. In one embodiment, wellhead 30 is shrouded with wellhead shroud 20, which receives a fluid such as water from tank 10 through line 29A, and the fluid returns to tank 10 through line 31.

Thus FIG. 1 demonstrates how a temperature controlled reactive fluid is transferred from a temperature controlled tank and injected into well 27 and into subterranean reservoirs 28. The water and other fluids in the shrouded conduits and pumps maintains the high pressure reactive fluid at a desirable temperature and maintains a means to capture and dilute any reactive fluid that may leak out from the inner high pressure conduit. In some embodiments, shrouds will serve to cool the reactive fluid, while in other embodiments they will serve to heat the reactive fluid. Thus, a reactive fluid is maintained at a proper temperature in a surface vessel located at a well site, tank 1, and the reactive fluid is then injected at the desirable temperature into well 27 to allow the injected reactive fluid and substances to reach the subterranean reservoirs 28 in a low reactive state, thereby allowing the reactive fluid to be injected far afield beyond the wellbore, 40, before the fluid and the substances react and release chemical energy. The position beyond the wellbore is shown in FIG. 1 as element 40.

In one embodiment, the temperature of the reactive fluid is continually monitored in the well using at least one temperature sensor such as optical fiber 32 using the OTDR DTS machine 12. Thus, FIG. 1 shows an exemplary embodiment that illustrates that the down hole temperature of an injected reactive fluid can be controlled from surface by adding or removing heat at surface from the fluid in tank 1 through the heat exchanger 5. It is clear to those familiar with the art of well treatment that multiple injection pumps 19 can be used to inject reactive fluid from multiple reactive fluid tanks 1 and the temperature controlled by multiple heat exchangers 5 and injected through multiple surface shrouded conduit lines 26 into single well 27 allowing higher injection rates into subterranean reservoirs 28.

Figure 2:
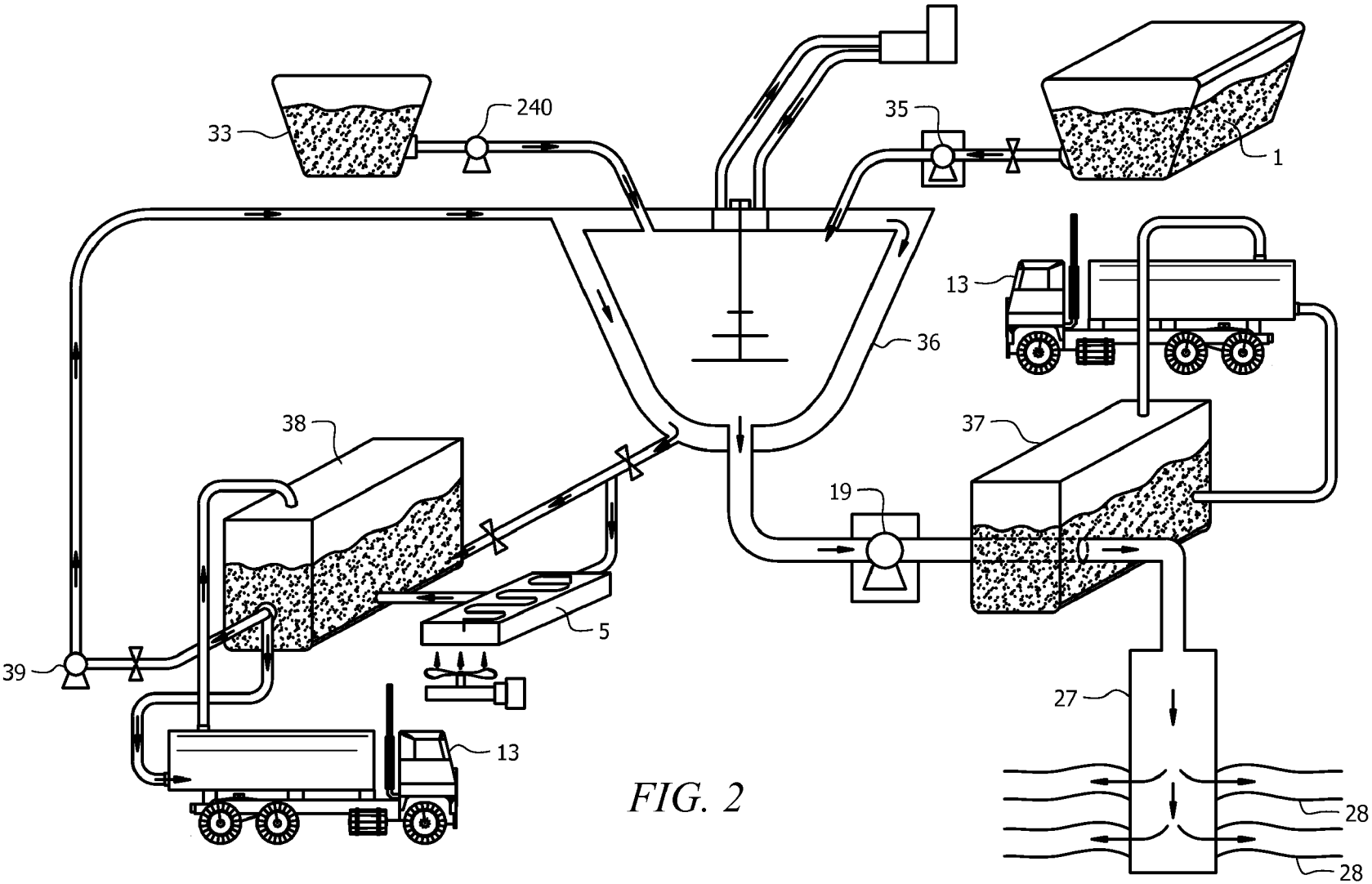
FIG. 2 is a schematic of the well site and equipment of the present invention.

In another embodiment shown in FIG. 2, a reactive fluid can be mixed with other materials in mixer 36. In one embodiment, temperature controlled tank 1 holds a cold fluid, like liquid nitrogen or liquid $CO_2$, which is delivered to blender vessel 36 through pump 35. Tank 1 can be temperature controlled by any known manner. A reactive material, like solid 90% hydrogen peroxide, is transferred into blender vessel 36 from tank 33 and the materials from tank 1 and tank 33 are then mixed into a pumpable form, such as a slurry, in blender vessel 36 and injected into well 27 through high pressure injection pump 19 and far into the subterranean reservoirs.

In another embodiment a reactive fluid like hydrogen peroxide can transferred from tank 1 at a controlled temperature, and solids like sand, ceramics, bauxite, proppants, and/or catalyst, can be added from tank 33 through a pump 240 into blender vessel 36. Other reactive fluids and solids can be used as are known in the art. In embodiments where the temperature of the fluid in vessel 36 is desired to be cold, solids from tank 33 are preferably cool or cold. The solids and reactive fluid are mixed and injected into the well 27 and out into the reservoir 28. Thus, reactive fluids are delivered into the reservoir 28 at a low temperature, increasing the distance the reactive fluid can be placed beyond the wellbore, releasing energy into the far field of subterranean reservoir 28.

In another embodiment a reactive fluid is transferred from tank 1 at a controlled temperature, and very cold solids can be added from tank 33 into blender vessel 36. The solids preferably have a temperature lower than the freezing point of the reactive fluid from tank 1, thereby causing the reactive fluid to freeze around and in the solids. The solids thusly coated with reactive fluid are pumped out of blending vessel 36 into well 27 and into the subterranean reservoirs 28. Thus, reactive fluids are delivered into the reservoir 28 at a low temperature, greatly increasing the distance the reactive fluid can be placed beyond the wellbore, releasing energy into the far field of subterranean reservoir 28.

For example, the fluid in blender vessel 36 is kept cool by adding cold fluids, such as, cryogenic fluids, liquid nitrogen, methanol, or water, from tank 38 through pump 39 to the shroud of vessel 36. Heat can be removed from mixing vessel 36 in heat exchanger 5. Likewise, if the surface environmental temperatures are lower than the reactive fluids freezing point, blender 36 can be heated via a shroud or other heat exchanging system, which receives fluid such as hot water from tank 38. Hot oiler truck 13 can heat the water in tank 38 using the propane burners and a heat exchanger on hot oiler truck 13. If desired, the slurry leaving blender vessel 36 can be further temperature controlled before well injection by adding or removing heat via a heat exchange fluid in tank 37, which can be controlled in any known manner, preferably with hot oiler truck 13 when heat, $Q_{IN}$, is required.

Once the injected fluid and solid warms up in the subterranean reservoir 28 and releases energy, $Q_{out}$, e.g., by igniting, the in-situ energized fluid in the reservoir can be flowed back to the well surface through a line to a surface tank. This high temperature reaction in the reservoir and the reaction products will combine and further enhance the in-situ hydrocarbons' ability to flow from the well.

Figure 3:
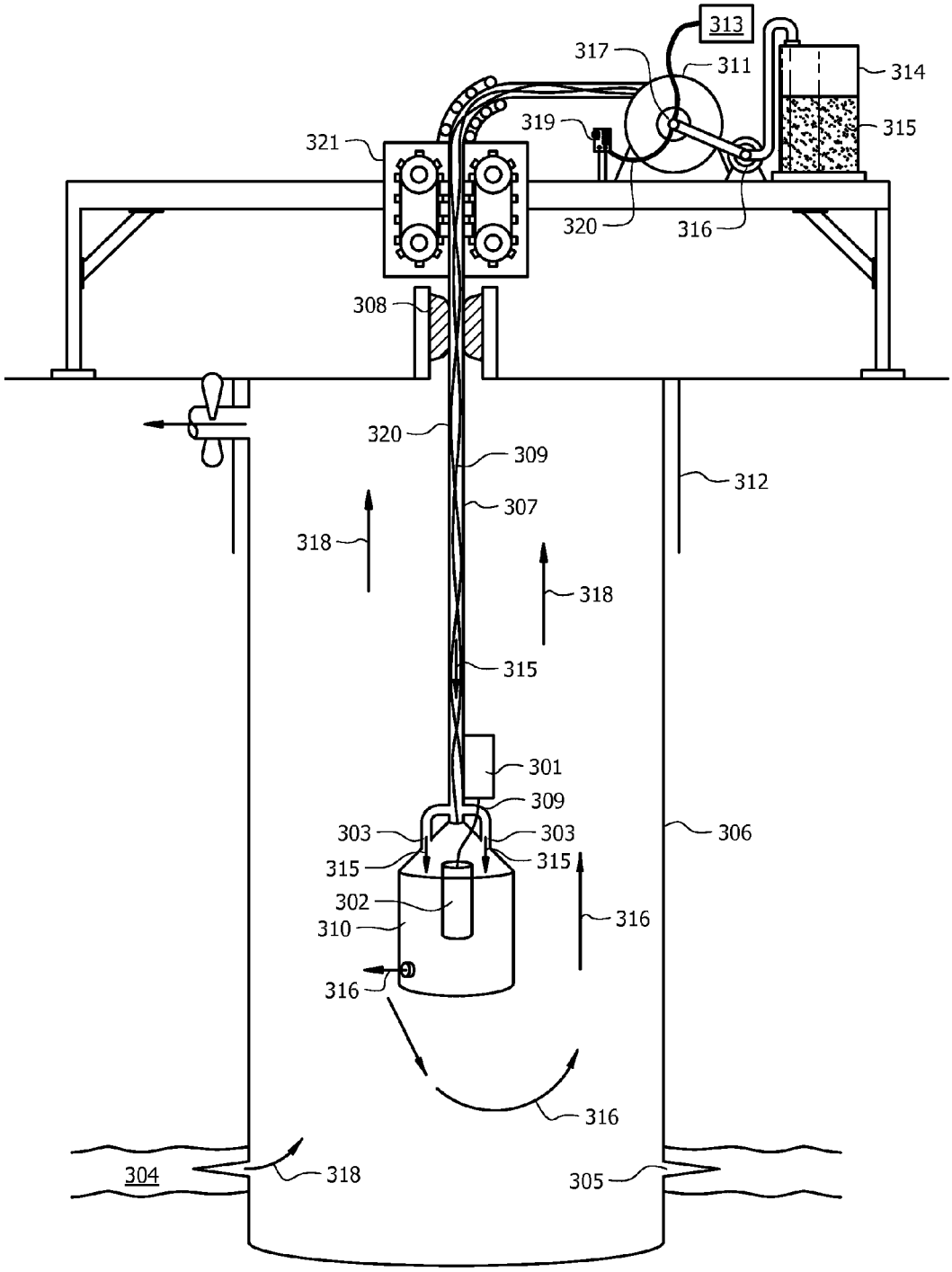
FIG. 3 is a schematic of an apparatus used to ignite monopropellants in a subterranean environment in a reaction chamber attached to a stainless steel coiled tubing while reciprocating the reaction chamber; and, FIG. 4 is a schematic of hydrogen sulfide gas sweetened in-situ.

FIG. 3 shows a schematic of an apparatus used to ignite monopropellants in a subterranean environment in a reaction chamber attached to a stainless steel coiled tubing while reciprocating the reaction chamber. In FIG., the reaction chamber, 310 has an igniter, 302, located in reaction chamber 310 and is connected to an electrical power transmission cable, 309. The electrical power transmission cable is interwoven in the continuous coiled tubing and the cable is connected to a battery and/or capacitor, 301. The battery and/or capacitor is positioned near the reaction chamber 310. The coiled tubing, 307, is lowered from a reeling device 311 or drum, through an elastomeric seal, 308. The elastomeric seal is located at the surface and separates the surface environment from the subterranean well environment containing the reaction chamber. The reactor chamber 310 is positioned in the well, 312, inside a well casing 306. In one aspect of the present invention, the igniter 302 inside the reaction chamber 310 is powered using electrical power from a surface source 313 and/or a subterranean source 301. Monopropellant fluid 315 is then pumped from a vessel 314 on surface with at least one pump 316 and the monopropellant fluid is transmitted through a swivel joint 317 and through the coiled tubing 309 on reel 311. The fluid is then ejected from atomizers 303 located inside the reaction chamber 310. Within the reaction chamber, 310, the atomized fluid is ignited using the igniter 302. The igniter is initiated using transmitted electrical power from the surface source 313, and/or the down hole source 301 to the igniter. Once the monopropellant 315 is ignited in the reaction chamber, the combustion products 316 are transmitted out of the reaction chamber 310 into the well casing 306 along with the heat produced by the combustion reaction within the chamber. The elastomeric seal 308 allows for the reciprocation of the coiled tubing 309 from surface. The coiled tubing is reciprocated from the surface to the reaction chamber 310 inside the well 312 while simultaneously pumping the monopropellant 315 into the coiled tubing 307. The coiled tubing is directed through the coiled tubing injector head 321, the elastomeric seal 308 and into the well casing 306. Also, the coiled tubing transports the electrical power to the igniter in the reaction chamber 310. Another function of the coiled tubing is to dispose the combustion products 316 and to direct the heat into the surrounding subterranean reservoir 304. While simultaneously flowing well fluids 318 from a subterranean reservoir 304 through perforations 305, directing combustion products 316 to surface and igniting monopropellant fluids 315 in the reaction chamber 310, the surface injector head 321 reciprocates the coiled tubing 309 in the well.

In FIG. 3, a Optical Time Domain Reflectometry machine, 319, directs light down an optical fiber 320 which is disposed in the coiled tubing 309. Directing light from the source 319 into the optical fiber 320 and monitoring the back scatter light reflected back to the optical machine, a computer 319 uses algorithms to analyze the reflected light and to determine the temperature profile of the well. Since an optical fiber is used, the entire length of the optical fiber 320 is capable of being used as a sensor.

Figure 4:
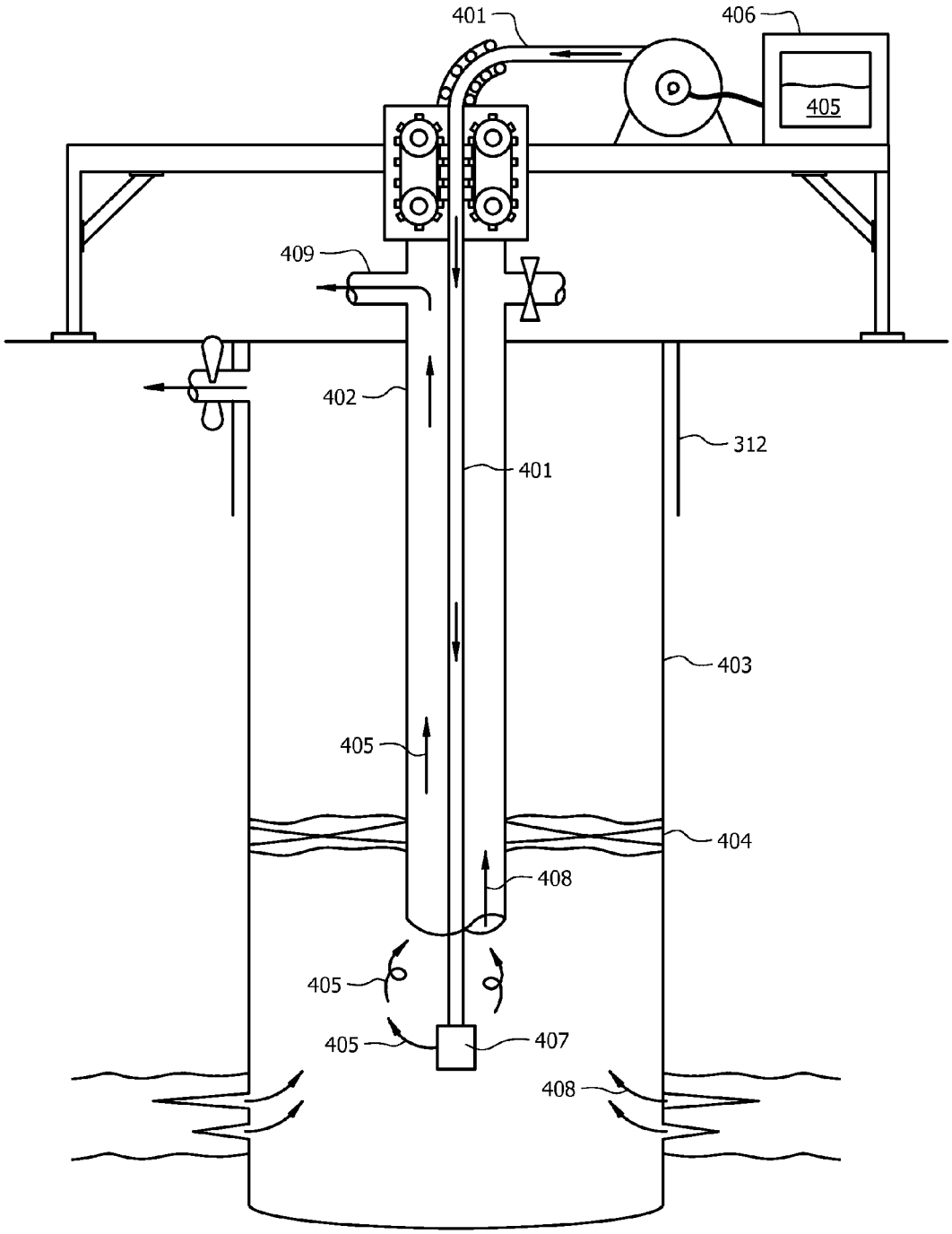

Now directing your attention to the FIG. 4 which illustrates hydrogen sulfide gas sweetened in-situ. In FIG. 4, a stainless steel continuous tube, 401, is disposed inside a production tubing 402. The production tubing is also disposed in a well casing 403. The well casing has a packer 404 located on the production tubing. This packer seals the well casing 403 above the packer 404 from fluids in the casing below the packer 404. Hydrogen peroxide fluid 405 is disposed in a temperature controlled vessel 406, and pumped into the stainless steel coiled tubing 401. As the hydrogen peroxide is pumped into the stainless steel coiled tubing, hydrogen peroxide is forced out an injection valve 407. This injection valve is located at the distal end of the coiled tubing 401 which provides a means for mixing the hydrogen peroxide 405 with hydrogen sulfide fluids 408 being produced in the subterranean reservoir. The mixing of the hydrogen peroxide with the hydrogen sulfide allows the subterranean hydrogen sulfide fluid being produced from the reservoir to react with the hydrogen peroxide fluid 405 being injected into the well 312. As stated above, the hydrogen peroxide is injected through the coiled tubing 401. This subterranean fluid mixing serves to remove hydrogen sulfide gas from the flowing well fluid 408. Because the fluid is flowing, the reaction products resulting from the reaction of hydrogen peroxide 405 and the well fluids with hydrogen sulfide gas 408 flows to the surface and these products are directed out of the well into a flow line 409 at surface.

In another embodiment, at least one hypergolic component is pumped down a wellbore. In yet another embodiment, at least two hypergolic components are separately pumped down a wellbore released such that they will mix in the wellbore. For example, a first reactive substance such as hydrogen peroxide is pumped from the surface into the wellbore and reservoir using one conduit, and a second substance that will spontaneously ignite with the first substance, such as ammonia, is pumped from the surface into the wellbore and reservoir using a separate conduit. The two substances will mix in the wellbore and subterranean formation forming a hypergolic fluid. The substances may, in some embodiments, be temperature, pressure controlled, and/or shrouded as described in any one of the above embodiments.

In any of the embodiments, the containers and conduits can be made from any material known in the art, such as stainless steel. The containers and/or conduits can, if desired, be passivated, coated with films, chemical films, or metal oxides, and/or otherwise treated to enhance the overall process. If a surface is passivated, it is desirable to test the surface for passivation at various times. In some embodiments, pressure monitoring and/or testing is desired for certain containers and/or conduits.

In another embodiment, a method provides energy to a subterranean environment by directing a reactive high energy density fluid from a surface source (such as a temperature controlled vessel), through surface lines, through a conduit (such as a coiled tubing) disposed in a wellbore, and into the wellbore where the fluid decomposes, ignites, or reacts to form products that comprise elemental oxygen. The energy of this reaction heats the surrounding formation. In addition, the elemental oxygen product reacts with in situ hydrocarbons to propagate additional reactions into the formation, which can generate heat, decompose heavy hydrocarbons and kerogen into lighter hydrocarbons, and increase the productivity of the well.

In an another aspect of the present invention, acoustical and/or seismic energy is transmitted from the surface to the reaction chamber. This energy is used to ignite an explosive in the reaction chamber. In an alternate and/or specific example, acoustical energy is used to heat at least one element in the reaction chamber.

In some embodiments, upon exiting the conduit, the fluid enters a down hole reaction chamber connected to the conduit. In the reaction chamber, the high energy density fluid is ignited, and atomized to aid the ignition. The reaction chamber can have a one-way valve that allows the fluid and/or reaction/decomposition products to exit the chamber and enter the formation, but prevents flow in the reverse direction. In some cases, the method includes reciprocating the reaction chamber (such as by moving the conduit) to release heat or reaction/decomposition products along a length of the wellbore. At or near the wellhead, the conduit is directed through an appropriate pack off elastomeric device to provide a seal.

In another embodiment, a method is provided for the in situ treatment of hydrogen sulfide. Hydrogen sulfide is a dangerous chemical with many undesirable qualities. Hydrogen peroxide reacts with hydrogen sulfide to produce elemental sulfur and other products. Moreover, hydrogen peroxide reacts with or interacts with many materials found in oxides of metals and subterranean minerals, with a very reactive catalyst being iron oxide. Hence the injection or transport of hydrogen peroxide into wells with iron or carbon steel tubulars, frac lines, or well heads is highly dangerous, and becomes exceedingly dangerous as the percentage of active hydrogen peroxide is increased.

In some embodiments, the current method uses a stainless steel (as opposed to carbon steel) conduit to carry substances, such as hydrogen peroxide, that react with hydrogen sulfide to produce desirable products, such as elemental sulfur. The reactant is delivered into a wellbore via a stainless steel conduit, where it reacts with the hydrogen sulfide to produce desirable products. Thus, as fluids are produced back, they contain less (or no) harmful hydrogen sulfide, which increases safety and saves time and money because the need to treat the hydrogen sulfide is reduced or eliminated. In any or all of the embodiments, the conduit is a continuous conduit, meaning that it is not made up from repeated threaded joints.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A method for the injection of a reactive substance into a subterranean environment comprising the steps of:

(a) providing a vessel adapted for controlling the temperature of a fluid in the vessel;

(b) directing a reactive fluid through the vessel such that the temperature of the fluid is controlled to control its reactivity;

(c) injecting the temperature controlled fluid through a wellbore and out into a reservoir;

(d) directing the fluid from the vessel through a shrouded component before the injecting step, and (e) monitoring at least one condition of said shrouded component.

2. The method of claim 1, further comprising the step of mixing one or more solids with the reactive fluid before the injecting step.

3. The method of claim 2, wherein the solids have a temperature just before mixing that is lower than the freezing point of the reactive fluid.

4. The method of claim 2, wherein the solid is selected from the group consisting of sand, bauxite, propellants, proppants, catalysts, and any combinations thereof.

5. The method of claim 1, wherein the reactive fluid is selected from the group consisting of hydrogen peroxide, hydrazine, monopropellants, hydrogen fluoride, hypergolic fluids, acids, bases, alcohols, diesel, propane, liquid natural gas, and any combination thereof.

6. The method of claim 1, further comprising providing a diluting fluid-filled shroud surrounding at least part of the vessel.

7. The method of claim 6, further comprising the step of controlling the temperature of the reactive fluid.

8. The method of claim 6, further comprising the step of circulating the diluting fluid from a source to the shroud, wherein the source provides temperature control of the diluting fluid.

9. The method of claim 1, wherein the shrouded component is selected from the group consisting of a conduit, pump, wellhead, and any combination thereof.

10. The method of claim 1, wherein the shrouded component contains a dilution fluid.

11. The method of claim 1, wherein the vessel comprises a heat exchanger system.

12. The method of claim 11, further comprising the step of providing a heating medium to the heat exchanger, wherein the heating medium is heated at a location physically separate from the vessel.

13. The method of claim 1, further comprising the step of monitoring the temperature of the vessel.

14. The method of claim 1, further comprising one or more of the following steps:

monitoring the temperature of the shrouded component;

monitoring the pressure of the shrouded component;

passivating a portion of the shrouded component;

circulating a shroud fluid through the shroud, wherein the shroud fluid is selected from the group consisting of water, a cryogenic fluid, a gas, carbon dioxide, and combinations thereof; and, monitoring the pressure of a shroud fluid in the shroud.

15. The method of claim 14, wherein temperature monitoring is provided in part by optical fibers as a distributive sensors.

16. The method of claim 15, wherein the optical fibers are monitored by an Optical Time Domain Reflectometer for distributive temperature profiles.

17. The method of claim 1, further comprising the step of maintaining and monitoring the pressure of the vessel.

18. The method of claim 1, further comprising the step of providing a protective coating to the vessel surfaces to be contacted by the reactive fluid.

19. The method of claim 1, further comprising the step of passivating a portion of the vessel.

20. The method of claim 1, wherein the reservoir is selected from the group consisting of oil shale reservoirs, tar sand reservoirs, coal bed methane reservoirs, light oil reservoirs, natural gas reservoirs, and any combinations thereof.

21. A method for the injection of a reactive substance into a subterranean environment comprising the steps of:

(a) providing a vessel adapted for controlling the temperature of a mixture in the vessel;

(b) directing a reactive substance in solid form to the vessel and mixing the solid with a cold fluid having a temperature just prior to mixing that is lower than the freezing point of the reactive solid;

(c) agitating the fluid and solid in the vessel to form a pumpable mixture of the solid and fluid;

(d) injecting the pumpable mixture through a wellbore and out into a reservoir such that at least a portion of the reactive substance remains in solid form until it is inside the wellbore.

22. The method of claim 21, wherein the reactive substance is selected from the group consisting of hydrogen peroxide, monopropellants, hydrogen fluoride, hypergolic fluids, alcohols, diesel, propane, hydrocarbons, and any combination thereof.

23. The method of claim 21, wherein the cold fluid is selected from the group consisting of cryogenic fluids, liquid nitrogen, methanol, water, ammonia, and any combination thereof.

24. The method of claim 21, further comprising one or more of the following steps:

adding additional solids to the vessel, wherein the solids are selected from the group consisting of sand, bauxite, propellants, proppants, catalysts, and any combinations thereof;

providing the vessel with a diluting fluid-filled shroud surrounding at least part of the vessel such that reactive substance leak would be diluted by the diluting fluid in the shroud;

directing the fluid from the vessel through a shrouded component before the injecting step; and, monitoring the temperature of the vessel in part using optical fibers.

25. The method of claim 24, wherein the optical fibers are monitored by an Optical Time Domain Reflectometer.

26. The method of claim 24, further comprising the step of circulating the diluting fluid from a source to the shroud and monitoring the temperature or pressure of the diluting fluid.

27. A method for the injection of a reactive substance into a subterranean environment comprising the steps of:

(a) providing a vessel adapted for controlling the temperature of a fluid in the vessel;

(b) directing a reactive fluid through the vessel such that the temperature of the fluid is controlled to control its reactivity;

(c) injecting the temperature controlled fluid through a wellbore and out into a reservoir, and (d) mixing one or more solids with the reactive fluid before the injecting step, wherein the solids have a temperature just before mixing that is lower than the freezing point of the reactive fluid.

28. The method of claim 27, wherein the reactive fluid is selected from the group consisting of hydrogen peroxide, hydrazine, monopropellants, hydrogen fluoride, hypergolic fluids, acids, bases, alcohols, diesel, propane, liquid natural gas, and any combination thereof.

29. The method of claim 27, further comprising providing a diluting fluid-filled shroud surrounding at least part of the vessel.

30. The method of claim 29, further comprising the step of controlling the temperature of the reactive fluid.

31. The method of claim 29, further comprising the step of circulating the diluting fluid from a source to the shroud, wherein the source provides temperature control of the diluting fluid.

32. The method of claim 27, further comprising the step of directing the fluid from the vessel through a shrouded component before the injecting step.

33. The method of claim 32, wherein the shrouded component is selected from the group consisting of a conduit, pump, wellhead, and any combination thereof.

34. The method of claim 32, wherein the shrouded component contains a dilution fluid.

35. The method of claim 32, further comprising one or more of the following steps:

monitoring the temperature of the shrouded component;

monitoring the pressure of the shrouded component;

passivating a portion of the shrouded component;

circulating a shroud fluid through the shroud, wherein the shroud fluid is selected from the group consisting of water, a cryogenic fluid, a gas, carbon dioxide, and combinations thereof; and, monitoring the pressure of a shroud fluid in the shroud.

36. The method of claim 35, wherein temperature monitoring is provided in part by optical fibers as a distributive sensors.

37. The method of claim 36, wherein the optical fibers are monitored by an Optical Time Domain Reflectometer for distributive temperature profiles.

38. The method of claim 27, wherein the vessel comprises a heat exchanger system.

39. The method of claim 38, further comprising the step of providing a heating medium to the heat exchanger, wherein the heating medium is heated at a location physically separate from the vessel.

40. The method of claim 27, further comprising the step of monitoring the temperature of the vessel.

41. The method of claim 27, further comprising the step of maintaining and monitoring the pressure of the vessel.

42. The method of claim 27, further comprising the step of providing a protective coating to the vessel surfaces to be contacted by the reactive fluid.

43. The method of claim 27, further comprising the step of passivating a portion of the vessel.

44. The method of claim 27, wherein the solid is selected from the group consisting of sand, bauxite, propellants, proppants, catalysts, and any combinations thereof.

45. The method of claim 27, wherein the reservoir is selected from the group consisting of oil shale reservoirs, tar sand reservoirs, coal bed methane reservoirs, light oil reservoirs, natural gas reservoirs, and any combinations thereof.

46. A method for the injection of a reactive substance into a subterranean environment comprising the steps of:

(a) providing a vessel adapted for controlling the temperature of a fluid in the vessel;

(b) directing a reactive fluid through the vessel such that the temperature of the fluid is controlled to control its reactivity;

(c) injecting the temperature controlled fluid through a wellbore and out into a reservoir, and (d) providing a diluting fluid-filled shroud surrounding at least part of the vessel.

47. The method of claim 46, further comprising the step of mixing one or more solids with the reactive fluid before the injecting step.

48. The method of claim 47, wherein the solid is selected from the group consisting of sand, bauxite, propellants, proppants, catalysts, and any combinations thereof.

49. The method of claim 46, wherein the solids have a temperature just before mixing that is lower than the freezing point of the reactive fluid.

50. The method of claim 46, wherein the reactive fluid is selected from the group consisting of hydrogen peroxide, hydrazine, monopropellants, hydrogen fluoride, hypergolic fluids, acids, bases, alcohols, diesel, propane, liquid natural gas, and any combination thereof.

51. The method of claim 46, further comprising the step of controlling the temperature of the reactive fluid.

52. The method of claim 46, further comprising the step of directing the fluid from the vessel through a shrouded component before the injecting step.

53. The method of claim 52, wherein the shrouded component is selected from the group consisting of a conduit, pump, wellhead, and any combination thereof.

54. The method of claim 52, wherein the shrouded component contains a dilution fluid.

55. The method of claim 52, further comprising one or more of the following steps:

monitoring the temperature of the shrouded component;

monitoring the pressure of the shrouded component;

passivating a portion of the shrouded component;

circulating a shroud fluid through the shroud, wherein the shroud fluid is selected from the group consisting of water, a cryogenic fluid, a gas, carbon dioxide, and combinations thereof; and, monitoring the pressure of a shroud fluid in the shroud.

56. The method of claim 55, wherein temperature monitoring is provided in part by optical fibers as a distributive sensors.

57. The method of claim 56, wherein the optical fibers are monitored by an Optical Time Domain Reflectometer for distributive temperature profiles.

58. The method of claim 46, wherein the vessel comprises a heat exchanger system.

59. The method of claim 58, further comprising the step of providing a heating medium to the heat exchanger, wherein the heating medium is heated at a location physically separate from the vessel.

60. The method of claim 46, further comprising the step of monitoring the temperature of the vessel.

61. The method of claim 46, further comprising the step of maintaining and monitoring the pressure of the vessel.

62. The method of claim 46, further comprising the step of providing a protective coating to the vessel surfaces to be contacted by the reactive fluid.

63. The method of claim 46, further comprising the step of passivating a portion of the vessel.

64. The method of claim 46, further comprising the step of circulating the diluting fluid from a source to the shroud, wherein the source provides temperature control of the diluting fluid.

65. The method of claim 46, wherein the reservoir is selected from the group consisting of oil shale reservoirs, tar sand reservoirs, coal bed methane reservoirs, light oil reservoirs, natural gas reservoirs, and any combinations thereof.

* * * * *